US008387640B2

(12) United States Patent
Kim

(10) Patent No.: US 8,387,640 B2
(45) Date of Patent: Mar. 5, 2013

(54) UMBRELLA DEVICE FOR AUTOMOBILE

(76) Inventor: Jonathan Kim, Monsey, NY (US)

( * ) Notice: Subject to any disclaimer, the term of this patent is extended or adjusted under 35 U.S.C. 154(b) by 0 days.

(21) Appl. No.: 13/434,489

(22) Filed: Mar. 29, 2012

(65) Prior Publication Data

US 2012/0180836 A1 Jul. 19, 2012

Related U.S. Application Data

(63) Continuation-in-part of application No. 12/751,878, filed on Mar. 31, 2010, now Pat. No. 8,276,607.

(51) Int. Cl.
*E04H 15/06* (2006.01)
*B60J 9/00* (2006.01)

(52) U.S. Cl. ..... 135/88.09; 135/88.07; 135/903; 296/154; 296/139

(58) Field of Classification Search ..... 135/88.01, 135/88.05, 88.07, 88.09, 88.1, 903, 48; 296/98, 296/99.1, 152, 154
See application file for complete search history.

(56) References Cited

U.S. PATENT DOCUMENTS

| | | | | | |
|---|---|---|---|---|---|
| 2,426,113 | A * | 8/1947 | Northcutt | 296/37.13 |
| 4,378,888 | A * | 4/1983 | Reed | 211/63 |
| 4,807,920 | A * | 2/1989 | Fujiki et al. | 296/37.8 |
| 5,476,302 | A * | 12/1995 | Ronci | 296/99.1 |
| 5,725,004 | A * | 3/1998 | Moulder | 135/20.2 |
| 5,800,004 | A * | 9/1998 | Ackeret | 296/37.13 |
| 6,044,856 | A * | 4/2000 | Cano | 135/88.07 |
| D492,640 | S * | 7/2004 | Greene et al. | D12/401 |
| 6,948,766 | B1 * | 9/2005 | Capote et al. | 296/152 |
| 7,604,281 | B1 * | 10/2009 | Raynor | 296/99.1 |
| 7,641,259 | B2 * | 1/2010 | Teshima et al. | 296/154 |
| 7,819,458 | B2 * | 10/2010 | Raynor | 296/99.1 |
| 8,240,323 | B2 * | 8/2012 | Lee | 135/88.07 |
| 2003/0192581 | A1 * | 10/2003 | Chang | 135/88.07 |
| 2007/0241586 | A1 * | 10/2007 | Clark | 296/152 |
| 2010/0078960 | A1 * | 4/2010 | Raynor | 296/154 |
| 2011/0010920 | A1 * | 1/2011 | Raynor | 29/525.01 |
| 2011/0240074 | A1 * | 10/2011 | Kim | 135/20.3 |
| 2012/0060345 | A1 * | 3/2012 | Raynor | 29/464 |

* cited by examiner

*Primary Examiner* — David Dunn
*Assistant Examiner* — Danielle Jackson
(74) *Attorney, Agent, or Firm* — John K. Park; Park Law Firm

(57) ABSTRACT

A retractable umbrella includes an umbrella holder, a retractable tube, a pulling rod, a rainshade screen, and a dripping guide. The umbrella holder is for receiving a regular umbrella and holding water dripped from the regular umbrella. The retractable tube comprises retractable reels, and it is attached on a door frame of a car. Each of the retractable reels is disposed in the retractable tube. The pulling rod is attached to a rim portion of the door accepting frame of the car. The rainshade screen comprises an outer edge, an inner edge, a front edge, and a rear edge. The outer edge is attached to the retractable reels of the retractable tube. The inner edge is attached to the pulling rod. The front edge connects front portions of the inner and outer edges. The rear edge connects rear portions of the inner and outer edges.

19 Claims, 6 Drawing Sheets

UMBRELLA DEVICE FOR AUTOMOBILE

RELATED APPLICATION

This application is a continuation-in-part of U.S. patent application Ser. No. 12/751,878 for "Umbrella for Automobile" filed on Mar. 31, 2010 now U.S. Pat. No. 8,276,607.

BACKGROUND OF THE INVENTION

The present invention relates to an umbrella device for automobile.

Automobiles are indispensable machine, which extend the range of human activities drastically.

However, one of the problems of automobiles may be a difficulty in handling rainy weather. Once the passenger gets into the car, he/she is OK. But, they can get soaked by the rain before getting in.

This awkward situations do not change a lot even when the passenger brings an umbrella. While opening and closing the umbrella, the passenger can be easily exposed to the rain, enough to be wet.

The inconvenience is amplified when a user accompanies old people or a baby in a baby seat. Furthermore, when the user carries something bulky and heavy on or with both hands or when a handicapped person tries to get in or off the car over an extended time period, the inconvenience becomes a pain. That is, the user need more hands to handle all those wet and urgent situations.

Another problem with rain or snow happens to some electrical or electronic devices provided on the inner side of the door such as power window or lock switches. Therefore, somehow the inner side of the car door needs to be protected against the rain shower.

Considering the wide usage of automobiles and the range of the problems, it has been a challenging problem to solve for a very long time.

Due to the difficulty of the problem, a clean and dry solution has not been suggested yet.

SUMMARY OF THE INVENTION

The present invention contrives to solve the disadvantages of the prior art.

An object of the invention is to provide an umbrella device for automobile.

An aspect of the invention provides a retractable umbrella and a holder for automobile as shown in FIG. 1.

The retractable umbrella comprises an umbrella holder, a retractable tube, a pulling rod, a rainshade screen, and a dripping guide.

The umbrella holder is for receiving a regular umbrella and holding water dripped from the regular umbrella, and comprises a receiving opening, a receptacle portion, and a releasing opening opened or closed by a faucet controlled by a car door operation.

The retractable tube comprises a plurality of retractable reels, and it is attached on a top portion of door frame of a car. Each of the retractable reels is disposed substantially evenly in the retractable tube.

The pulling rod is configured to be attached to a rim portion of the door accepting frame of the car.

The rainshade screen has a general shape of a wedge, and the rainshade screen comprises an outer edge, an inner edge, a front edge, and a rear edge. The outer edge is attached to the plurality of retractable reels of the retractable tube. The inner edge is attached to the pulling rod. The front edge connects front portions of the inner and outer edges. The rear edge connects rear portions of the inner and outer edges.

The dripping guide extends from the front edge of the rainshade screen, collects water from the rainshade screen, and guides the collected water into the receptacle portion of the umbrella holder. The umbrella holder is disposed at an inner portion of the car door so as to collect the drip water from the rainshade screen and the regular umbrella received in the receptacle portion.

The umbrella holder may have a shape of a partially cut-out cone, and the umbrella holder may be disposed obliquely such that the collected water is collected and kept inside.

When the car door is closed the releasing opening of the umbrella holder may be closed by the faucet such that the collected water is kept inside the umbrella holder, and when the car door is opened the releasing opening of the umbrella holder may be opened by the faucet such that the collected water is released outside the car through the releasing opening.

The retractable umbrella device may further comprise a pulling string connected from the faucet to a fastener for fixing an end of the pulling string to the door frame of the car, and when the car door is opened the pulling string pulls the faucet to open and when the car door is closed the pulling string exerts no force on the faucet such that the faucet is closed.

An end of the dripping guide may be disposed downward and into the receptacle portion of the umbrella holder.

The dripping guide may be flexible, such that a portion thereof is folded up when the car door is closed and the portion may be straightened out to provide downward flow path for the water from the rainshade screen when the car door is opened.

When the door opens the rainshade screen is unrolled from the retractable tube and deployed between the top portions of the car door and the car door accepting frame and work as an umbrella.

When the door is closed the rainshade screen is retracted into the retractable tube without interfering the car door's closing operation.

The retractable tube may further comprise a central axis for supporting the retractable reels in the retractable tube.

The retractable tube may further comprise an opening slot for allowing the rainshade screen.

The pulling rod may be queued through a hole provided along the inner edge of the rainshade screen.

The pulling rod may further comprise two end stopper disposed at both ends of the pulling rod for preventing the rainshade screen from sliding off.

The retractable umbrella may further comprise one or more first fasteners disposed along the rim portion of the door accepting frame of the car, and the one or more first fasteners may be configured to hold the pulling rod.

The retractable umbrella may further comprise one or more second fasteners disposed at the outer portion of the retractable tube, and the one or more second fasteners may be configured to hold the pulling rod.

The rainshade screen may be water-repellent.

The front edge may be disposed to drip water into the drip water collector.

The drip water collector may have a shape of funnel, and the drip water collector may comprises: a top opening configured to collect drip water from the front edge of the rainshade screen; a draining pipe portion disposed at a lower portion of the drip water collector and configured to drain water; and a stopper disposed at the draining pipe portion.

The drip water collector may be configured to accept a closed umbrella.

The dripping guide may have a funnel shape. The dripping guide may comprise a wide mouth portion and a narrow mouth portion, and the wide mouth portion may be connected to the front edge of the rainshade screen and the narrow mouth portion leads into the drip water collector.

The advantages of the present invention are: (1) the umbrella for automobile can be deployed conveniently; and (2) the umbrella for automobile can be retrieved easily.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

The U.S. patent application Ser. No. 12/751,878 is incorporated by reference into this disclosure as if fully set forth herein.

Figure 1:
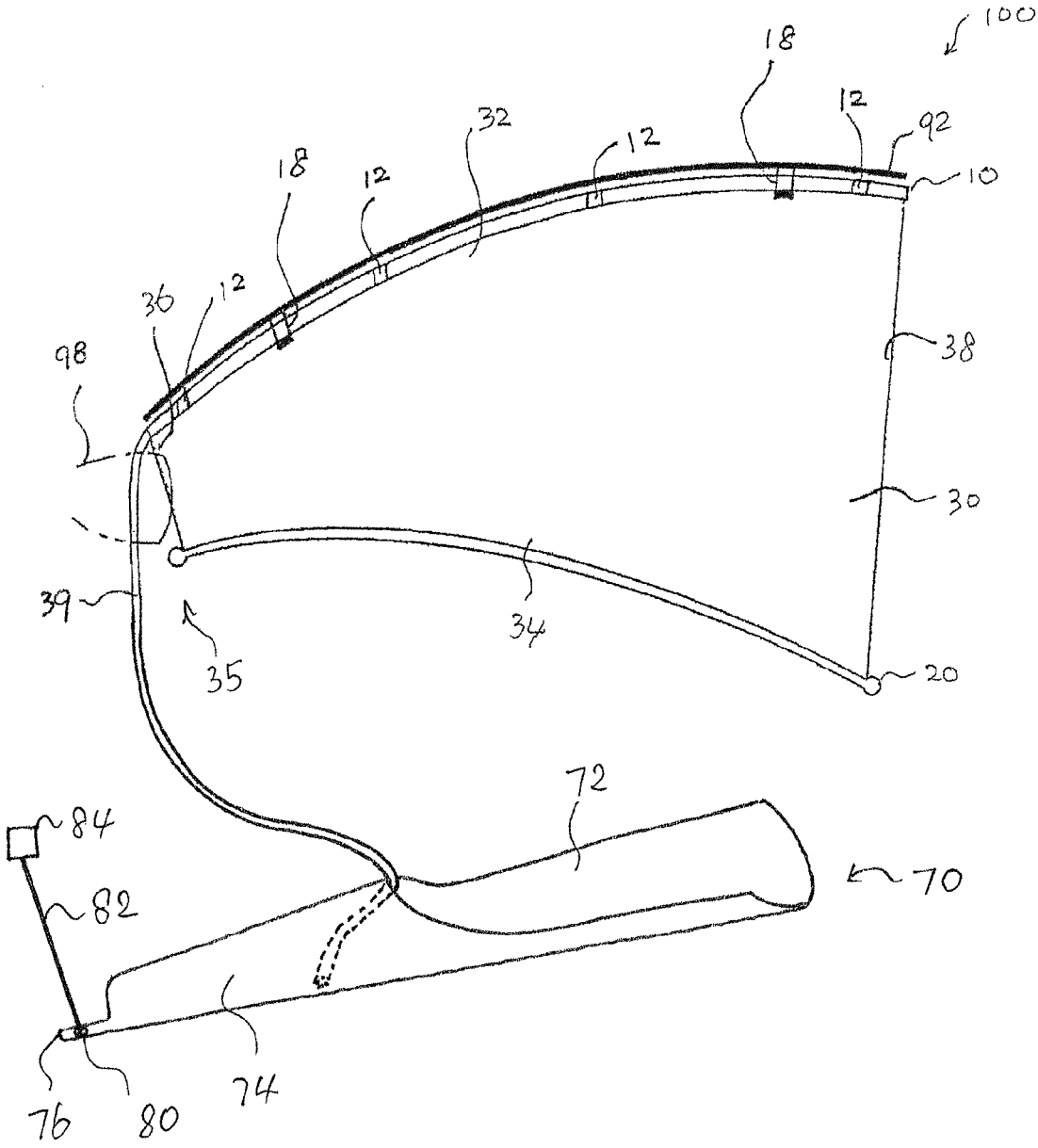
FIG. 1 is a perspective schematic view showing a retractable umbrella device for automobile according to an embodiment of the invention.
Figure 2A:
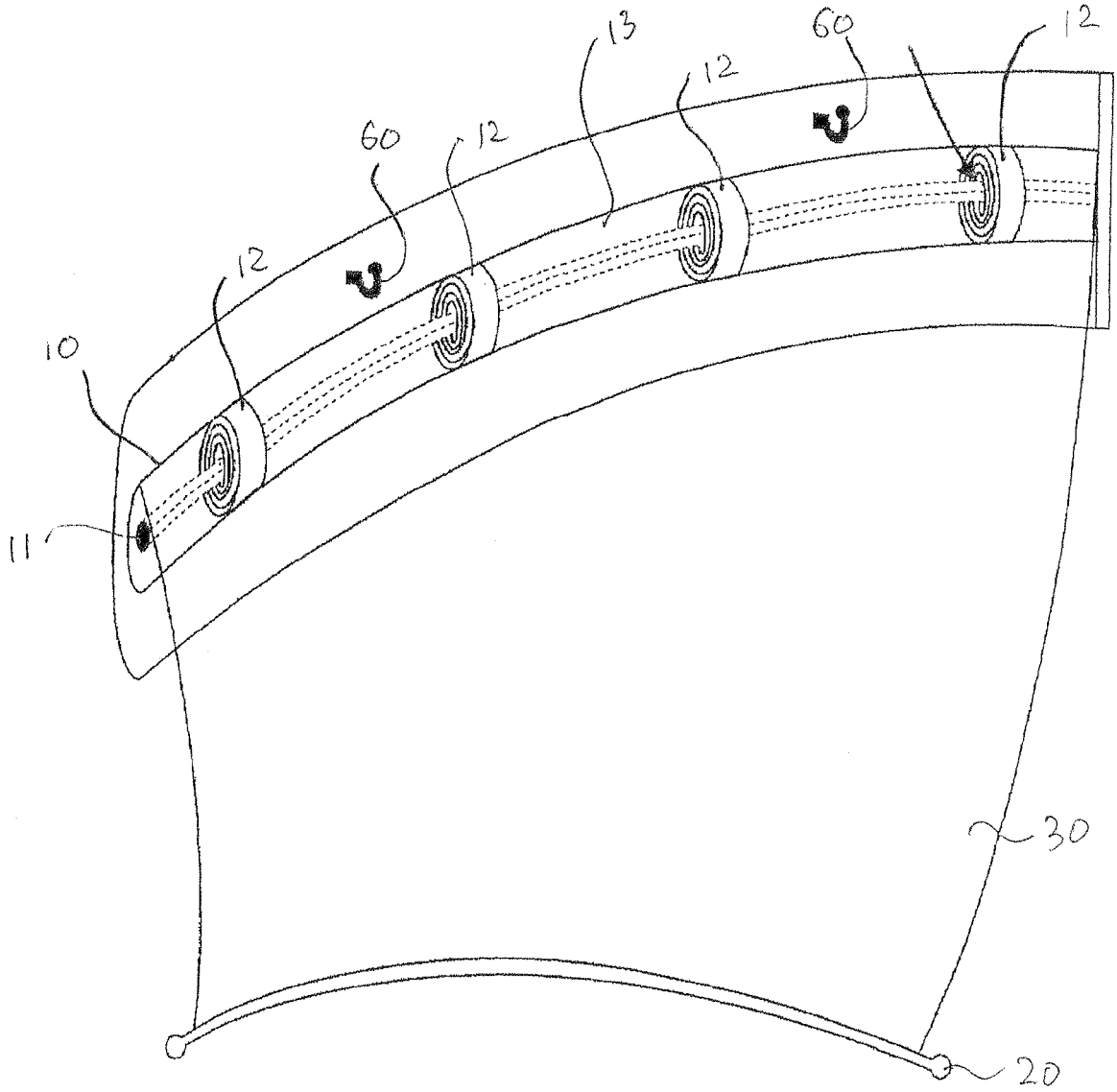
FIG. 2*a* is a perspective blow-up view of a retractable tube, a pulling rod, and a rainshade screen according to an embodiment of the invention.
Figure 2B:
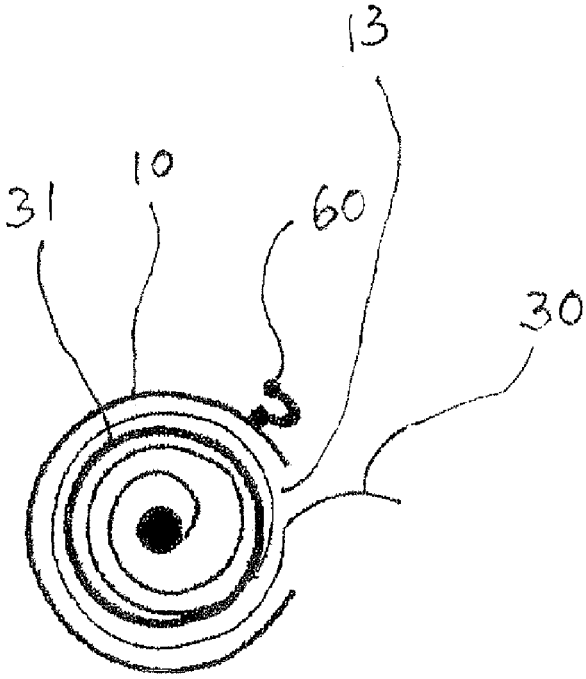
FIG. 2*b* is a cross-sectional view showing a retractable reel in the retractable tube in FIG. 2*a;*
Figure 2C:
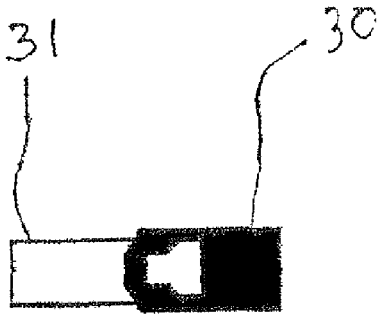
FIG. 2*c* is a plan view showing a connection between a retractable reel and a rainshade screen.
Figure 3:
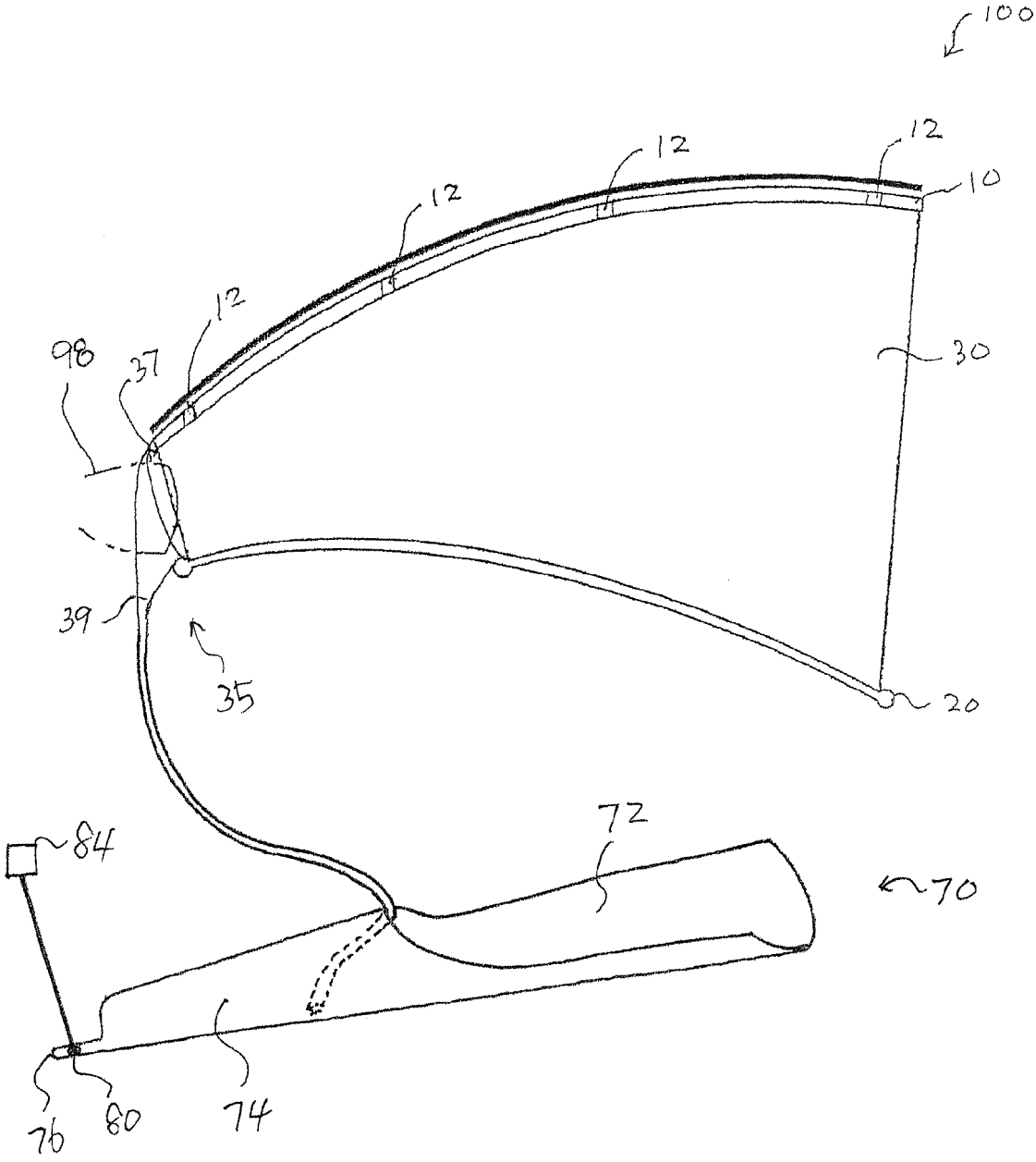
FIG. 3 is another perspective schematic view showing a retractable umbrella device for automobile according to another embodiment of the invention.

FIGS. 1-3 show retractable umbrella for automobile according to embodiments of the invention.

An aspect of the invention provides a retractable umbrella 100 for automobile as shown in FIG. 1.

The retractable umbrella device 100 comprises an umbrella holder 70, a retractable tube 10, a pulling rod 20, a rainshade screen 30, and a dripping guide 35.

Figure 6:
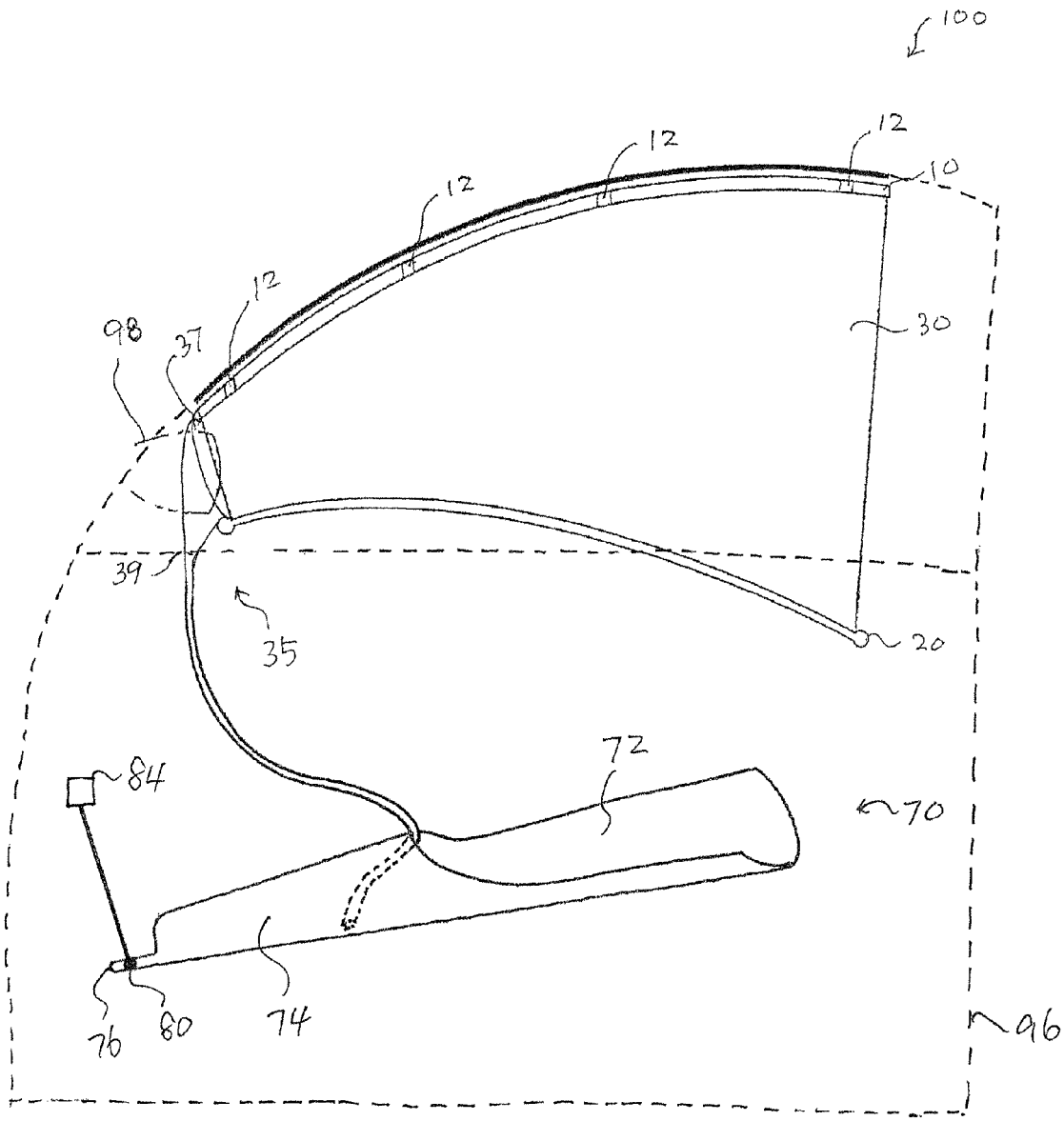
FIG. 6 is another perspective schematic view showing a retractable umbrella device for automobile installed on a car door according to another embodiment of the invention.

The umbrella holder 70 is for receiving a regular umbrella (not shown) and holding water dripped from the regular umbrella, and comprises a receiving opening 72, a receptacle portion 74, and a releasing opening 76 opened or closed by a faucet 80 controlled by a car door 96 operation as shown in FIGS. 1 and 3. The umbrella holder 70 is disposed on an inner surface of the car door 96 as shown in FIG. 6.

The retractable tube 10 comprises a plurality of retractable reels 12, and it is attached on a top portion of door frame 92 of a car. Each of the retractable reels 12 is disposed substantially evenly in the retractable tube 10.

Figure 5:
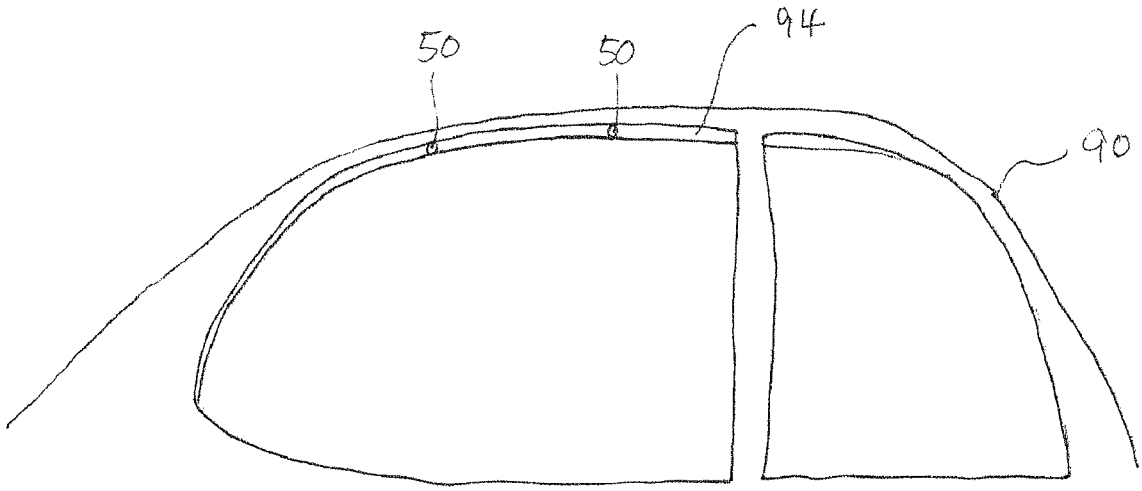
FIG. 5 is a perspective view of first fasteners for holding a pulling rod according to an embodiment of the invention.

The pulling rod 20 is configured to be attached to a rim portion of the door accepting frame 94 of the car as shown in FIG. 5.

The rainshade screen 30 has a general shape of a wedge, and the rainshade screen comprises an outer edge 32, an inner edge 34, a front edge 36, and a rear edge 38. The outer edge 32 is attached to the plurality of retractable reels 12 of the retractable tube 10. The inner edge 34 is attached to the pulling rod 20. The front edge 36 connects front portions of the inner and outer edges 32, 34. The rear edge 38 connects rear portions of the inner and outer edges 32, 34.

The dripping guide 35 extends from the front edge 36 of the rainshade screen 30, collects water from the rainshade screen 30, and guides the collected water into the receptacle portion 74 of the umbrella holder 70. The umbrella holder 70 is disposed at an inner lower portion of the car door 96 so as to collect the drip water from the rainshade screen 30 and the regular umbrella received in the receptacle portion 74.

The umbrella holder 70 may have a shape of a partially cut-out cone, and the umbrella holder 70 may be disposed obliquely such that the collected water is collected and kept inside.

When the car door 96 is closed the releasing opening of the umbrella holder 70 may be closed by the faucet 80 such that the collected water is kept inside the umbrella holder 70, and when the car door 96 is opened the releasing opening of the umbrella holder 70 may be opened by the faucet 80 such that the collected water is released outside the car through the releasing opening 76.

The retractable umbrella device 100 may further comprise a pulling string 82 connected from the faucet 80 to a fastener 84 for fixing an end of the pulling string 82 to the door frame 92 of the car, and when the car door 96 is opened the pulling string 82 pulls the faucet 80 to open and when the car door 96 is closed the pulling string 82 exerts no force on the faucet 80 such that the faucet 80 is closed.

An end of the dripping guide 35 may be disposed downward and led into the receptacle portion 74 of the umbrella holder 70.

The dripping guide 35 may be flexible, such that a portion thereof is folded up when the car door 96 is closed and the portion may be straightened out to provide downward flow path for the water from the rainshade screen 30 when the car door 96 is opened.

When the car door 96 opens the rainshade screen 30 is unrolled from the retractable tube 10 and deployed between the top portions of the car door 96 and the car door accepting frame 94 and work as an umbrella.

When the car door 96 is closed the rainshade screen 30 is retracted into the retractable tube 10 without interfering the car door's closing operation.

The retractable tube 10 may further comprise a central axis 11 for supporting the retractable reels 12 in the retractable tube 10 as shown in FIG. 2.

The retractable tube 10 may further comprise an opening slot 13 for allowing the rainshade screen 30 as shown in FIG. 2.

Figure 4:
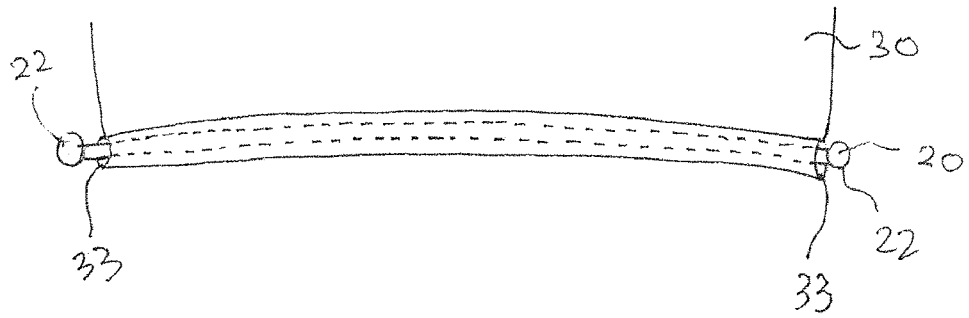
FIG. 4 is a partial view of a pulling rod queued through a rainshade screen according to an embodiment of the invention.

The pulling rod 20 may be queued through a hole 33 provided along the inner edge 34 of the rainshade screen 30 as shown in FIG. 4.

The pulling rod 20 may further comprise two end stoppers 22 disposed at both ends of the pulling rod 20 for preventing the rainshade screen 30 from sliding off as shown in FIG. 4.

The retractable umbrella 100 may further comprise one or more first fasteners 50 disposed along the rim portion 94 of the door accepting frame 94 of the car 90, and the one or more first fasteners 50 may be configured to hold the pulling rod 20.

The retractable umbrella 100 may further comprise one or more second fasteners 60 disposed at a top portion of the retractable tube 10, and the one or more second fasteners 60 may be configured to hold the pulling rod 20.

The rainshade screen 30 may be water-repellent.

The front edge 36 may be disposed to drip water into the dripping guide 35.

The dripping guide 35 may have a funnel shape as shown in FIG. 3. The dripping guide 35 may comprise a wide mouth portion 37 and a narrow mouth portion 39, and the wide mouth portion 37 may be connected to the front edge 36 of the rainshade screen 30 and the narrow mouth portion 39 leads into the umbrella holder 70.

In certain embodiments of the invention, the dripping guide 35 may include a single hose and extends directly from a portion of the front edge 36, for example from a portion close to the retractable tube 10 as shown in FIG. 1.

The umbrella 100 for automobile according to the present invention can be installed to the car door 96 and the door accepting frame 94 with customized fastening devices built into the car by the car manufacturers.

Otherwise, the umbrella 100 for automobile may be installed and attached to the car door 96 by a regular fastener such as a loop and hook fastener (Velcro®) 18 as shown in FIG. 1. The pulling rod 20 also can be attached with such a fastener (not shown).

In FIGS. 2*b*-2*c*, more details of the retractable tube 10 are shown. In the illustrated embodiment, the retractable reel 12 comprises a metal strip portion 31 connected to the rainshade screen 30.

The retractable reels 12 may engage the central axis 11 such that the retractable reels 12 may change the angle with the central axis 11 while the rainshade screen 30 is deployed or retracted.

In FIGS. 1 and 3, a side mirror 98 is shown to indicate relative positions of the elements.

In certain embodiments of the invention, the narrow mouth portion 39 leads directly into the receptacle portion 74 of the umbrella holder 70 by penetrating an uncut portion of the umbrella holder 70. Thereby, the narrow mouth portion 39 can be disposed closely to the hinge of the car door 96, making its length shorter.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A retractable umbrella device for automobile comprising:

an umbrella holder for receiving a regular umbrella and holding water dripped from the regular umbrella, comprising a receiving opening, a receptacle portion, and a releasing opening opened or closed by a faucet controlled by a car door operation;

a retractable tube comprising a plurality of retractable reels, and attached on a top portion of door frame of a car, wherein each of the retractable reels is disposed substantially evenly in the retractable tube;

a pulling rod configured to be attached to a rim portion of the door accepting frame of the car;

a rainshade screen having a general shape of a wedge, wherein the rainshade screen comprises an outer edge, an inner edge, a front edge, and a rear edge, wherein the outer edge is attached to the plurality of retractable reels of the retractable tube, wherein the inner edge is attached to the pulling rod, wherein the front edge connects front portions of the inner and outer edges, and wherein the rear edge connects rear portions of the inner and outer edges; and a dripping guide extending from the front edge of the rainshade screen, collecting water from the rainshade screen, and guiding the collected water into the receptacle portion of the umbrella holder, wherein the umbrella holder is disposed at an inner portion of the car door so as to collect the drip water from the rainshade screen and the regular umbrella received in the receptacle portion.

2. The retractable umbrella device of claim 1, wherein the umbrella holder has a shape of a partially cut-out cone, and wherein the umbrella holder is disposed obilquely such that the collected water is collected and kept inside.

3. The retractable umbrella device of claim 2, wherein when the car door is closed the releasing opening of the umbrella holder is closed by the faucet such that the collected water is kept inside the umbrella holder, and wherein when the car door is opened the releasing opening of the umbrella holder is opened by the faucet such that the collected water is released outside the car through the releasing opening.

4. The retractable umbrella device of claim 3, further comprising a pulling string connected from the faucet to a fastener for fixing an end of the pulling string to the door frame of the car, wherein when the car door is opened the pulling string pulls the faucet to open and when the car door is closed the pulling string exerts no force on the faucet such that the faucet is closed.

5. The retractable umbrella device of claim 1, wherein an end of the dripping guide is disposed downward and into the receptacle portion of the umbrella holder.

6. The retractable umbrella device of claim 5, wherein the dripping guide is flexible, such that a portion thereof is folded up when the car door is closed and the portion is straightened out to provide downward flow path for the water from the rainshade screen when the car door is opened.

7. The retractable umbrella device of claim 1, wherein when the door opens the rainshade screen is unrolled from the retractable tube and deployed between the top portions of the car door and the car door accepting frame and works as an umbrella.

8. The retractable umbrella device of claim 7, wherein when the door is closed the rainshade screen is retracted into the retractable tube without interfering the car door's closing operation.

9. The retractable umbrella device of claim 7, wherein the retractable tube further comprises a central axis for supporting the retractable reels in the retractable tube.

10. The retractable umbrella device of claim 7, wherein the retractable tube further comprises an opening slot for allowing the rainshade screen.

11. The retractable umbrella of claim 1, wherein the pulling rod is queued through a hole provided along the inner edge of the rainshade screen.

12. The retractable umbrella device of claim 11, wherein the pulling rod further comprises two end stopper disposed at both ends of the pulling rod for preventing the rainshade screen from sliding off.

13. The retractable umbrella device of claim 12, further comprises one or more first fasteners disposed along the rim portion of the door accepting frame of the car, wherein the one or more first fasteners are configured to hold the pulling rod.

14. The retractable umbrella device of claim 12, further comprising one or more second fasteners disposed at an outer portion of the retractable tube, wherein the one or more second fasteners are configured to hold the pulling rod.

15. The retractable umbrella device of claim 1, wherein the rainshade screen is repellent to water.

16. The retractable umbrella device of claim 15, wherein the front edge is disposed to drip water into the dripping guide.

17. The retractable umbrella device of claim 1, wherein the umbrella holder is configured to accept a closed umbrella.

18. The retractable umbrella device of claim 1, wherein the dripping guide has a funnel shape.

19. The retractable umbrella device of claim 18, wherein the dripping guide comprises a wide mouth portion and a narrow mouth portion, and wherein the wide mouth portion is connected to the front edge of the rainshade screen and the narrow mouth portion leads into the umbrella holder.

* * * * *